United States Patent [19]

Bagus

[11] Patent Number: 4,658,692

[45] Date of Patent: Apr. 21, 1987

[54] CONTROL CIRCUIT FOR SHADED-POLE MOTOR

[75] Inventor: Brian M. Bagus, Bartlett, Ill.

[73] Assignee: The Marmon Group, Inc., Chicago, Ill.

[21] Appl. No.: 715,532

[22] Filed: Mar. 25, 1985

[51] Int. Cl.[4] ..... G10H 1/047

[52] U.S. Cl. ..... 84/1.24; 84/1.25; 84/DIG. 10; 318/341

[58] Field of Search ..... 84/1.24, 1.25, DIG. 10; 318/341, 313, 327

[56] References Cited

U.S. PATENT DOCUMENTS

| | | | |
|---|---|---|---|
| 2,887,000 | 7/1955 | Leslie | 84/1.25 |
| 2,995,054 | 8/1961 | Leslie | 84/1.25 |
| 3,080,786 | 3/1963 | Leslie | 84/1.25 |
| 3,783,360 | 1/1974 | Bundy | 318/341 |

*Primary Examiner*—Stanley J. Witkowski

*Assistant Examiner*—David Warren

*Attorney, Agent, or Firm*—Neuman, Williams, Anderson & Olson

[57] ABSTRACT

A control circuit for shaded-pole motors used in an acoustic pulsato system for producing special musical effects. The system includes a horn-type loudspeaker connected to a shaded-pole motor and/or a drum-type loudspeaker connected to a shaded-pole motor. Each type of loudspeaker has a feedback circuit and a means for the operator to select the desired speed for the motor. The feedback circuit quickly adjusts the actual speed of the motor to correspond to the selected speed by controlling the amount of current or power supplied to the motor. The drum-type loudspeaker feedback circuit also includes a braking circuit to quickly stop the motor and the drum rotation to prevent unpleasant spurious signals which occur if the drum loudspeaker is permitted to coast to a stop on a slower speed.

2 Claims, 2 Drawing Figures

CONTROL CIRCUIT FOR SHADED-POLE MOTOR

BACKGROUND OF THE INVENTION

1. Field Of The Invention

This invention relates to an electronic system for controlling the speed of a shaded-pole motor. The present invention is designed for use in acoustic devices producing pulsato and other musical effects.

2. Prior Art

In an acoustic pulsato system for producing the fast or full pulsato speed, the acoustic rotor is rotated at about five to eight revolutions per second and for slow operation the rotational speed of the rotor is about one-half to one revolution per second. One prior art system for producing pulsato is described in U.S. Pat. No. 3,245,284 which discloses a main motor for driving a rotor at full pulsato speed, and a secondary motor having an axially floating rotor that is spring-biased normally to be out of alignment with its stator, which when energized pulls the floating rotor into alignment with the stator by solenoid action. This movement is utilized to provide a releasable frictional coupling between the shaft of the secondary motor and a friction wheel carried on the main motor shaft. When the secondary motor is energized and the main motor deenergized, the acoustic rotor is driven at the slower speed of the secondary motor. A disadvantage of this system is that when the main drive motor is turned off following operation at full pulsato speed, the rotor slowly coasts to a stop without any braking effect, and produces undesirable droning sounds. This is overcome by the system described in U.S. Pat. No. 4,198,880, which also uses two motors but which provides automatic braking from full pulsato speed to either "slow" speed or to a completely stopped condition. The motors employed in both systems are preferably of the shaded-pole type, but the fact remains that two motors are required to provide "slow" and "fast" operation.

Other pulsato producing systems are also known in which an acoustic rotor is belt-driven by a single drive motor and adjustment of pulsato rate between "fast" and "slow" is accomplished with multi-step pulleys. Such systems suffer the disadvantage that different sets of pulleys are required for different line current frequencies.

In addition to the above, shaded-pole motors in general have heretofore been controlled by changing the impressed voltage in response to shaft speed information derived by means of a tachometer. This prior art system suffers the serious defect of taking a long time to slow down; thus, if used in an acoustic pulsato system, the earlier-mentioned undesirable droning sounds would be produced when going from "fast" to "slow" operation, or from "slow" to stop.

Another prior art system is disclosed in U.S. Pat. No 4,348,625 which teaches dual feedback means interactively connected to the gate electrode of a triac in the AC current line of a shaded-pole motor. One feedback loop controls speed through a frequency/phase detector to adjust the time delay of triac gating relative to the zero crossing points of each half-cycle of AC voltage until the tachometer sensed speed of the motor corresponds to a desired speed set by a voltage controlled oscillator. The feedback loop adjusts the time delay of the triac gating relative to the zero crossing points of every alternate half-cycle of AC power and decelerates the motor by an impressed half-wave pulsed DC current. One significant drawback of this system is that it does not provide error signals frequently enough to integrate over the time period and generate a control signal for the motor. Therefore a large time constant in the integration portion of the system is required which results in a tendency of the system to "hunt". This effect is commonly described in a feedback type of circuit as having the system overcompensate in one direction and then correct by under compensating in the other direction and accordingly oscillate about a particular value or point.

It is a general object of the present invention to provide a feedback loop for controlling the speed of a horn and a separate feedback loop to control the speed of a drum to produce pulsato or other musical effect.

It is another object of the present invention to provide a braking circuit for the drum to prevent undesirable distortion in the audio.

It is a specific object of the present invention to provide a feedback loop for a horn including a first pulse width modulator circuit which modulates a tachometer signal from the motor with a DC reference signal to provide a pulse having a width proportional to the motor speed and a second pulse width modulator circuit which modulates the integrated signal from the first pulse width modulated signal with a full wave rectified signal from the AC power line to provide a control pulse to adjust the time delay of a triac gating to adjust the motor speed.

It is a specific object of the present invention to provide a feedback loop for a drum including a first pulse width modulator circuit which modulates a tachometer signal from the motor with a DC reference signal to provide a pulse having a width proportional to the motor speed and a second pulse width modulator circuit which modulates the integrated signal from the first pulse width modulated signal with a full wave rectified signal from the AC power line to provide a control pulse to adjust the time delay of a triac gating to adjust the motor speed.

It is another specific embodiment of the present invention to provide a brake circuit for use with the drum to decelerate the drum when slowing or stopping.

SUMMARY OF THE INVENTION

The present invention involves a feedback control system for a shaded-pole motor used in a musical device for producing pulsato or other effects. The overall system includes a first feedback loop for use with a first shaded-pole motor which is connected by belts to rotate a horn type loudspeaker assembly and a second feedback loop including a brake circuit for use with a second shaded-pole motor which is connected by belts to rotate a drum type loudspeaker assembly for lower audio frequency production.

In the feedback control system a loop associated with the horn assembly uses a pulse width modulated signal to adjust the time delay of triac gating relative to zero crossing points of each half-cycle of AC to vary the amount of power applied to the motor. The operator can select the speed setting of off, slow or fast for the speed of the horn assembly. A tachometer signal is obtained from the motor based upon nineteen pulses per revolution. The tachometer signal is shaped and filtered to provide a pulse signal with a width proportional to the speed of the motor. If the speed of the motor is different than the speed selected by the operator, the width of the pulse will vary and the resultant power supplied to the motor via the triac will vary to adjust the motor speed. The speed proportional pulse signal is applied to the positive input of a FET circuit operating as a pulse width modulator. A DC reference signal representing the desired speed selected is applied as the second input to the FET. The FET provides a pulse output signal with a width proportional to the speed of the motor.

The pulse output signal from the pulse width modulator is then integrated and the resulting DC level signal is applied as the negative or modulating input to a second FET circuit operating as a pulse width modulator. The AC power signal is now full wave rectified, clipped, slightly phase shifted and applied at the positive input of the second pulse width modulator circuit. The second pulse width modulator circuit provides a triggering pulse output signal to a triac circuit. The triac is triggered during each half-cycle of the AC signal and the delay time before the triac triggers is determined by the width of the pulse from the second pulse width modulator. If the pulse from the second pulse width modulator is wide then the triac is triggered early in the half-wave cycle of the AC signal and power is applied to the motor causing it to speed up. If the pulse from the second pulse width modulator is narrow, the triac is triggered later in the half-wave cycle of the AC and the triac provides a smaller amount of power to the motor causing the motor to speed up by a small amount or causing the motor to slow down. Since the modulating signal to the positive input of the second pulse width modulating circuit determines the triggering point on the full wave rectified input from the AC line, the triggering point is updated at the speed of the motor and is easy to integrate and the time constants are selected to be more sensitive to minor fluctuations.

The feedback control system portion or loop associated with the drum assembly operates in the same manner as the feedback control system or loop for the horn assembly but also includes a brake circuit to effectively stop the drum from rotating during deceleration. A tachometer signal is obtained from the motor. The tachometer signal is shaped and filtered to provide a pulse signal with a width proportional to the motor speed. This signal is applied to the positive input of a pulse width modulator. A DC reference signal corresponding to the speed of rotation selected by the operator is applied to the negative input of the pulse width modulator.

The signal from the pulse shaper circuit is also passed through a detector circuit which provides an output signal if the motor is running. The output signal from the detection circuit is used to gate the braking circuit.

The output of the pulse width modulator is integrated and applied to the negative input of a second pulse width modulator. The same input applied to the positive input of the second pulse width modulator for the horn circuit is applied to the second pulse width modulator of the drum circuit. The output of the second pulse width modulator is applied to a triac which functions as described above.

When the drum is slowing down there is no output signal from the second pulse width modulator. The output from the inverter is high and is applied to a schmidt trigger. The AC power line signal is half-wave rectified and applied as the second input to the schmidt trigger. The output signal from the schmidt trigger is applied to a second schmidt trigger and the signal from the turning detector is applied to the other input. The output of the second schmidt trigger is inverted and applied to the triac circuit to adjust the time delay of the triac gating relative to the zero crossing points of every alternate half-cycle of AC power and decelerates the motor by an impressed half-wave pulsed DC current.

DETAILED DESCRIPTION

Figure 1:
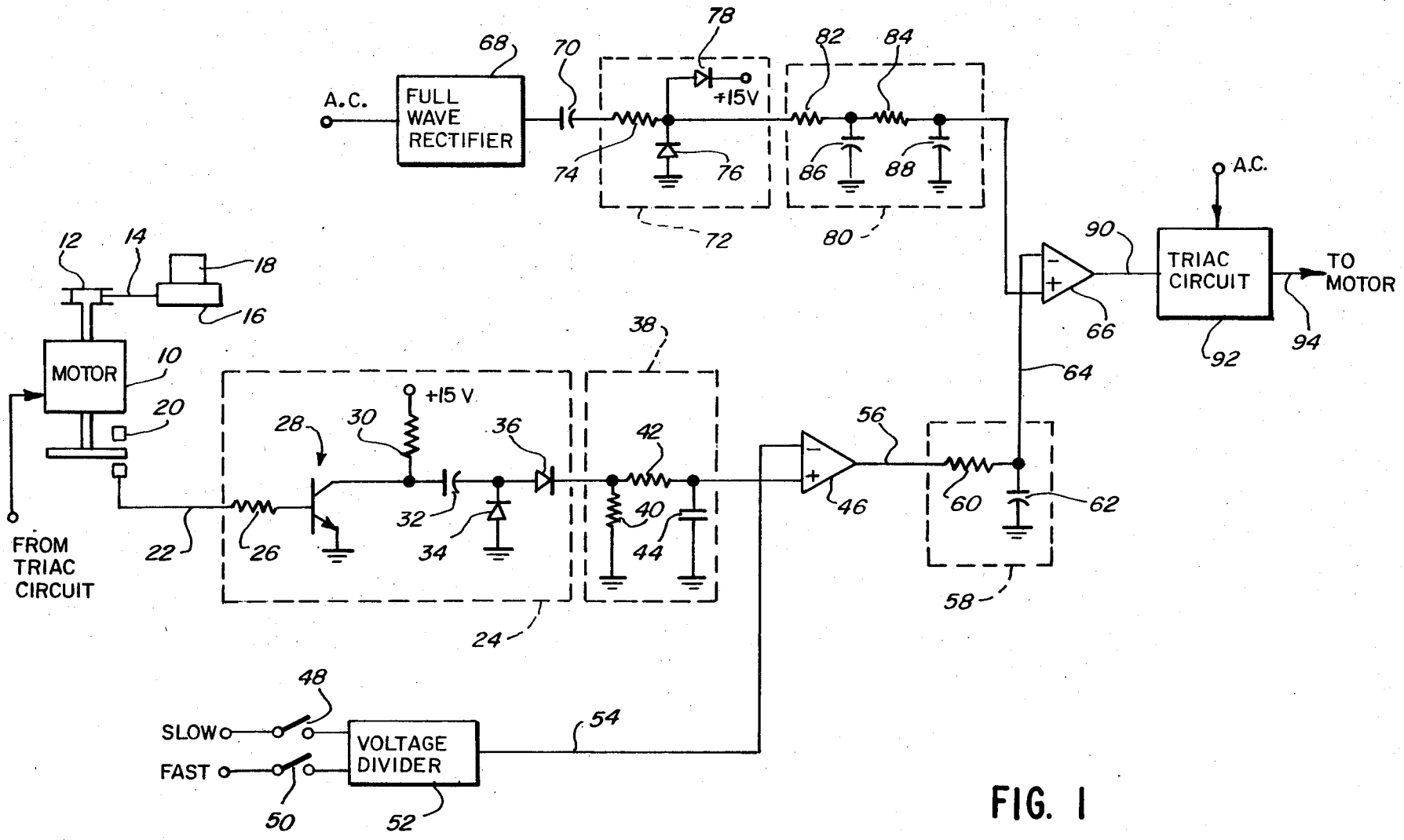
FIG. 1 is a schematic diagram of the horn feedback loop circuit.

FIG. 1 shows the feedback loop for the horn assembly. A variable speed shaded-pole type motor 10 is provided with a pulley 12 which is coupled by a belt 14 to a rotor 16 of the horn assembly 18. The speed of rotation of the rotor 16 determines the pulsato rate for the horn assembly 18. The shaft speed of a motor 10 is sensed by a suitable tachometer 20. The tachometer 20 can be any one of several types. In the preferred embodiment, the tachometer is an optical sensor which provides a pulse output on line 22 for each tooth of the motor wheel or nineteen pulses per revolution.

Each pulse on line 22 is applied to a pulse shaper circuit 24 which comprises a resistor 26, a transistor 28, a voltage source connected through resistor 30 to the output of transistor 28, a capacitor 32 and two diodes 34 and 36. The pulse output of pulse shaper circuit 24 is applied to the filter circuit 38. The filter circuit comprises resistors 40 and 42 and capacitor 44. The pulse output of the filter circuit 38 has a pulse width, and if the speed of the motor is much less than that desired, the pulse output from filter 38 is narrow while if the speed of the motor is slightly less than that desired, the pulse output from filter 38 is wider and if the speed of the motor is greater than that desired, the pulse output from filter 38 is still wider. The pulse output of filter circuit 38 is applied to the positive input of pulse width modulator 46.

The operator has control of two switches 48 and 50, for slow or fast operation, respectively, of the horn assembly. Each switch is connected to a voltage divider circuit 52 which provides a different level signal at the output line 54 depending upon which input switch 48 or 50 is closed. The output line 54 from voltage divider 52 is connected as the negative input to pulse width modulator 46. If the voltage level signal on line 54 is low, switch 48 closed for slow operation, the width of the pulse output of pulse width modulator 46 is greater than if the voltage level signal on line 54 is high, switch 50 closed for fast operation. The width of the output pulse on line 56 from pulse width modulator 46 is determined by the motor speed and the operator's selection of slow or fast operation.

The pulse output on line 56 is applied to integrator circuit 58 which comprises resistor 60 and capacitor 62. The output of integrator 58 is a DC level signal on line 64. The DC voltage output signal of integrator 58 is proportional to the pulse width of the signal on line 56. Accordingly, if the pulse width of the signal on line 56 is wide, the DC voltage output signal on line 64 is higher than if the pulse width of the signal on line 56 is narrow. The DC level output on line 64 is applied to the negative input of pulse width modulator 66.

The AC line voltage is full wave rectified in rectifier 68 and applied through coupling capacitor 70 to the input of clipper circuit 72. The clipper circuit 72 comprises the resistor 74 and diodes 76 and 78 and limits the peak to peak swing of the rectified signal to 15 volts about a 7.5 volts axis. The clipped output signal is applied to the filter and phase shifter circuit 80 which comprises resistors 82, 84 and capacitors 86 and 88. The signal output of the filter and phase shift circuit 80 is applied as the positive input to the second pulse width modulator 66. If the DC output voltage on line 64 from integrator circuit 58 is high, then the pulse output of the second pulse width modulator 66 is narrow and the triac circuit 92 is gated on for a short period of time. If the DC output voltage on line 64 from integrator circuit 58 is low, then the pulse output of the second pulse width modulator 66 is wide and the triac circuit 92 is gated on for a long period of time.

The output of the second pulse width modulator 66 is applied on line 90 to a triac circuit 92. The triac circuit also receives the AC signal and provides an output signal on line 94 to the motor. The amount of power provided to the motor on line 94 determines the speed of the motor. If the pulse from the second pulse width modulator 66 is wide, the triac circuit 92 is gated or triggered early in the AC cycle and power is applied from the point of triggering through the zero crossing point of the AC cycle. If the pulse from the second pulse width modulator 66 is narrow, the triac circuit 92 is gated or triggered later in the AC cycle and accordingly less power is applied on line 94 to the motor.

Figure 2:
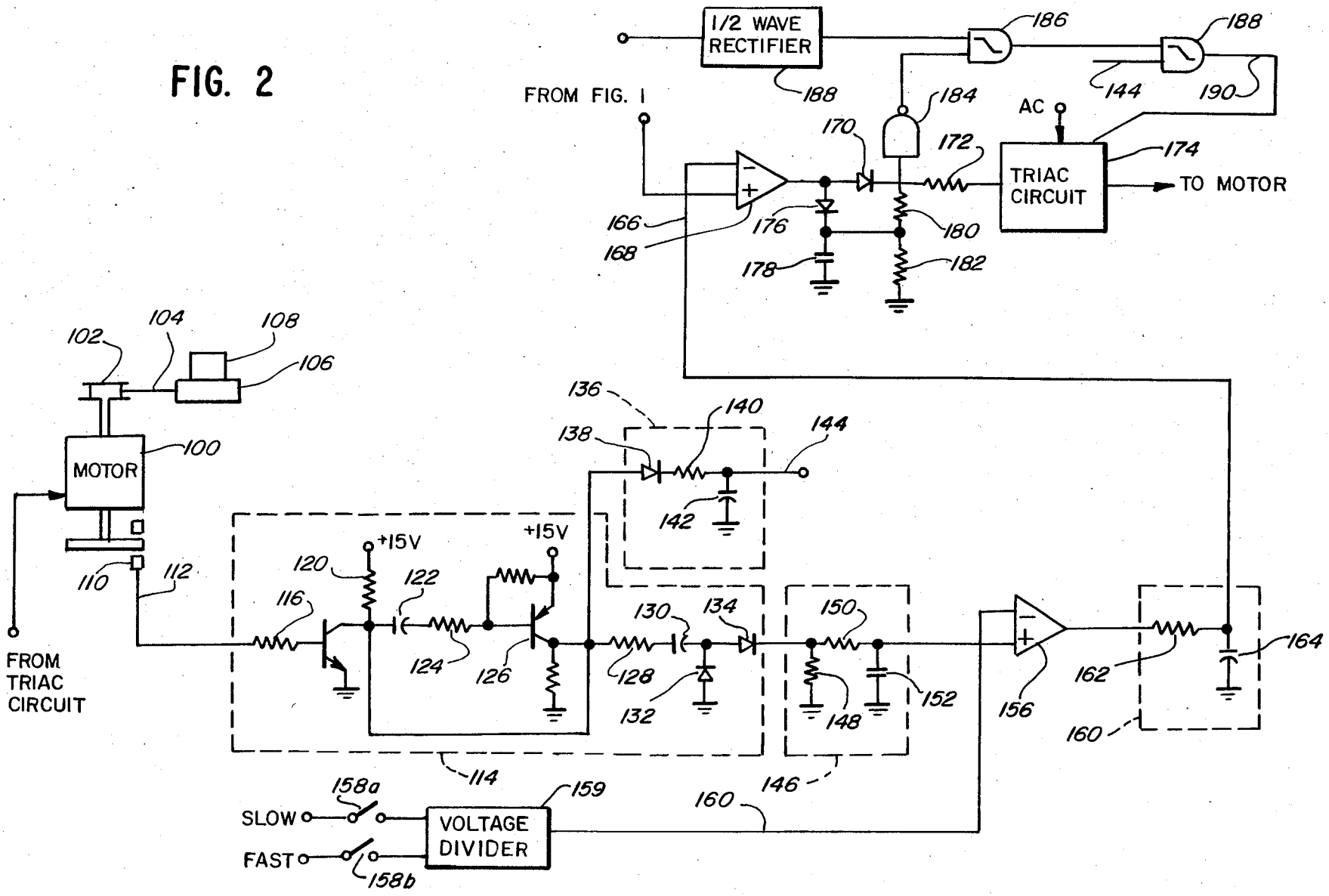
FIG. 2 is a schematic diagram of the drum feedback loop circuit.

FIG. 2 shows the feedback loop for the drum assembly. A variable speed shaded-pole motor 100 is provided with a pulley 102 which is coupled by a belt 104 to a rotor 106 of the drum assembly 108. The shaft speed of the motor 100 is sensed by a suitable tachometer 110.

The tachometer provides a number of pulses per revolution of the motor wheel on the output line 112. Each pulse on line 112 is applied to the input of a pulse shaper circuit 14. The pulse shaper circuit 114 comprises an input resistor 116, transistor 118, a voltage source applied via resistor 120 to the output of transistor 118, resistor 128, capacitor 130 and diodes 132 and 134. The output of transistor 118 is also applied via capacitor 122, resistor 124 and transistor 126 to a turning detector circuit 136. The turning detector 136 comprises a diode 138, resistor 140 and capacitor 142 and provides a signal on output line 144 when the motor is turning.

The output of the pulse shaper circuit 114 is applied to the input of a filter circuit 146. The filter circuit 146 comprises resistors 148 and 150 and capacitor 152 and provides a pulse output on line 154 which has a width proportional to the motor speed with the slower the motor the wider the pulse width. The pulse signal on line 154 is applied to the positive input of pulse width modulator 156. The operator can close switch 158*a* or 158*b* and apply through the voltage divider circuit 159, a DC reference voltage on line 160 to the negative input of pulse width modulator 156 to indicate the desired speed of rotation of the drum. The pulse output signal of modulator 156 is proportional to the speed of the motor 100.

The output of pulse width modulator 156 is applied to the integrator 160. The integrator comprises resistor 162 and capacitor 164 and provides a DC level output signal on line 166. The DC level output signal on line 166 is applied as the negative input to pulse width modulator 168. The full wave rectified AC signal which has been clipped, filtered and phase shifted and applied as the positive input to the second pulse width modulator of FIG. 1 is also applied as the positive input to pulse width modulator 168.

The output pulse signal from the second pulse width modulator 168 is applied via diode 170 and resistor 172 to the input of triac circuit 174. The width of the pulse determines the time delay of the triggering of the triac and accordingly the power applied to the motor.

When the motor 100 is running at the desired speed and being supplied power then the output from pulse width modulator 168 charges capacitor 178 through diode 176. The output of inverter 184 is low causing gate 186 to be nonconducting. If the motor 100 is turned off by opening both switches 158*a* and 158*b* or if the motor 100 is running at the fast speed and the operator selects the slow speed by opening switch 158*b* and closing switch 158*a*, the speed of the motor 100 must stabilize before additional power is necessary and accordingly there is no output from pulse width modulator 168. Under these circumstances the output from inverter 184 is high. The schmidt trigger 186 receives the high signal from inverter 184 and the half-wave rectified AC signal from half-wave rectifier 188. The output of schmidt trigger 186 is a pulse for every positive cycle of the AC waveform. The output signal from schmidt trigger 186 is provided as an input to a second schmidt trigger 188. The output signal on line 144 from the turning detector 136 is applied as the second input to the second schmidt trigger 188. If the drum is rotating, the output on line 144 together with the signal output from schmidt trigger 186 cause the second schmidt trigger 188 to be conducting. When the second schmidt trigger 188 is conducting the output signal is a pulse on line 190 for every positive cycle of the AC waveform while the motor 100 is turning. The pulse on line 190 is applied to triac circuit 174 which causes a breaking signal to be applied to the motor 100 forcing the drum to stop rotating. Accordingly, when the operator switches from fast to slow operation or from fast to stop operation or from slow to stop operation a breaking signal is applied to the motor 100 to prevent the drum from coasting and producing an undesirable drowning sound.

What is claimed:

1. A musical system for producing special effects having a rotatable horn type loudspeaker, a shaded-pole motor connected to the loudspeaker for rotating same, means to detect the motor speed and to produce an output signal indicative of the motor speed and a feedback control means for receiving the output signal indicative of the motor speed and for producing a control signal to adjust the motor speed, the feedback control comprising:

shaper circuit means for receiving said output signal indicative of the motor speed and for producing a pulse signal with a width proportional to the motor speed;

speed selection means for providing at least one selection signal representative of the desired motor speed;

a first pulse width modulator means for receiving said speed proportional pulse signal and said selection signal and producing a pulse output signal having a width proportional to the speed of said motor;

integrator circuit means for receiving the output pulse signal from said first pulse width modulator means and producing an integrated DC signal output;

circuit means for receiving and rectifying an AC power signal and providing a rectified signal;

second pulse width modulator means for receiving said rectified signal and said integrated DC signal and providing a pulse output signal;

control circuit means for receiving said AC power signal and said pulse output from said second pulse width modulator means and providing a control signal output to adjust the speed of said motor.

2. A musical system for producing special effects having a rotatable drum type loudspeaker, a shaded-pole motor connected to the loudspeaker for rotating same, means to detect the motor speed and to produce an output signal indicative of the motor speed and a feedback control means for receiving the output signal indicative of the motor speed and for producing a control signal to adjust the motor speed, the feedback control comprising:

a shaper circuit means for receiving said output signal indicative of the motor speed and producing a pulse signal with a width proportional to the motor speed and a turning signal indicative of the motor operating;

speed selection means for providing at least one selection signal representative of the desired motor speed;

a first pulse width modulator means for receiving said speed proportional signal and said selection signal and producing a pulse output signal having a width proportional to the speed of said motor;

integrator circuit means for receiving the output pulse signal from said first pulse width modulator means and producing an integrated DC signal output;

circuit means for receiving and rectifying an AC power signal and providing a rectified signal;

second pulse width modulator means for receiving said rectified signal and said integrated DC signal and providing a pulse output signal;

circuit means for receiving and half-wave rectifying an AC power signal and providing a half-wave rectified signal;

braking circuit means for receiving said half-wave rectified signal and said turning signal and sensing the absence of said pulse output signal from said second pulse width modulator and producing a brake signal;

control circuit means for receiving said AC power signal, said pulse output from said second pulse width modulator means and said braking signal and providing a control signal output to adjust the speed of said motor.

* * * * *